US009250605B2

(12) United States Patent
Tokuda

(10) Patent No.: US 9,250,605 B2
(45) Date of Patent: Feb. 2, 2016

(54) PROCESS UNIT AND IMAGE FORMING APPARATUS PROVIDED WITH THE SAME

(71) Applicant: Sharp Kabushiki Kaisha, Osaka (JP)

(72) Inventor: Takashi Tokuda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/380,143

(22) PCT Filed: Jan. 28, 2013

(86) PCT No.: PCT/JP2013/051740
§ 371 (c)(1),
(2) Date: Aug. 21, 2014

(87) PCT Pub. No.: WO2013/125300
PCT Pub. Date: Aug. 29, 2013

(65) Prior Publication Data

US 2015/0037066 A1 Feb. 5, 2015

(30) Foreign Application Priority Data

Feb. 24, 2012 (JP) ..... 2012-038658

(51) Int. Cl.
*G03G 21/16* (2006.01)
*G03G 21/18* (2006.01)

(52) U.S. Cl.
CPC ..... *G03G 21/1814* (2013.01); *G03G 21/169* (2013.01); *G03G 21/1647* (2013.01); *G03G 21/1671* (2013.01); *G03G 2221/0063* (2013.01)

(58) Field of Classification Search
CPC ..... G03G 15/0812; G03G 15/0808; G03G 15/0834; G03G 15/0865; G03G 15/0881; G03G 15/0891; G03G 15/2017; G03G 15/2028; G03G 15/6502; G03G 15/6532; G03G 21/0064; G03G 21/0094; G03G 21/08
See application file for complete search history.

(56) References Cited

U.S. PATENT DOCUMENTS

| | | | | |
|---|---|---|---|---|
| 6,467,965 | B1 * | 10/2002 | Wyer | 384/295 |
| 7,272,342 | B2 * | 9/2007 | Nagashima et al. | 399/117 |
| 2005/0128282 | A1 * | 6/2005 | Yamagata | 347/230 |
| 2008/0199213 | A1 * | 8/2008 | Saito et al. | 399/117 |
| 2010/0221041 | A1 * | 9/2010 | Takai et al. | 399/159 |

FOREIGN PATENT DOCUMENTS

| | | |
|---|---|---|
| JP | 09-179473 | 7/1997 |
| JP | 2011-197531 | 10/2011 |

* cited by examiner

*Primary Examiner* — Roy Y Yi
(74) *Attorney, Agent, or Firm* — Keating & Bennett, LLP

(57) ABSTRACT

A process unit includes a first shaft portion at a first end of a photoreceptor drum that is fitted into a hole of a first receiving portion so as to move the photoreceptor drum from a front side of a mounting space to the inside of the mounting space. The photoreceptor drum is temporarily supported by a repulsive force of a cleaning blade and positioned in a predetermined position in the mounting space. Then, in order to cause a lock member to support a second shaft portion at a second end of the photoreceptor drum, the lock member is retracted against a biasing force of a biasing member. The second shaft portion at the second end of the photoreceptor drum is supported by the lock member by a restoring force of the biasing member, so that the photoreceptor drum is locked in a mounted state.

7 Claims, 10 Drawing Sheets

PROCESS UNIT AND IMAGE FORMING APPARATUS PROVIDED WITH THE SAME

CROSS-REFERENCE TO RELATED APPLICATIONS

This application is a National Phase application filed under 35 USC 371 of PCT International Application No. PCT/JP2013/051740 with an International Filing Date of Jan. 28, 2013, which claims under 35 U.S.C. §119(a) the benefit of Japanese Application No. 2012-038658, filed Feb. 24, 2012, the entire contents of which are incorporated herein by reference.

TECHNICAL FIELD

The present invention relates to a cartridge type process unit configured integrally with a plurality of maintenance components that include a photoreceptor drum and have a different life span, and to an image forming apparatus provided with such a unit.

BACKGROUND ART

In an electrophotographic image forming apparatus such as a digital copier and a printer, since image quality is remarkably affected, a photoreceptor drum is replaced periodically or as needed. However, mainly because the photoreceptor drum includes a hazardous substance, measures of taking care not to directly touch the photoreceptor drum at the time of the replacement, or preventing waste toner from a cleaning device from causing a surrounding area to be contaminated at the time of removal of the photoreceptor drum are required, so that the handling of the photoreceptor drum is difficult and the replacement of the photoreceptor drum has been performed at the time of maintenance by a serviceman.

Therefore, since the replacement operation of a photoreceptor drum always has to be performed by a serviceman on request, which causes inconvenience, in recent years, a device in which image forming portions such as a photoreceptor drum, and a cleaning device, a charger, and a developing device that are arranged around the photoreceptor drum are formed as a cartridge type process unit and integrally handled, which simplifies maintenance and enables the replacement of a photoreceptor drum to be easily performed not only by a serviceman but also by a user has been developed (see Patent Literature 1, for example). In such a process unit, when the photoreceptor drum reaches the end of a life span and a user performs the replacement of the photoreceptor drum, the entire process unit has been replaced and a used process unit has been discarded as it is.

CITATION LIST

Patent Literature

Literature 1: Japanese Patent Laid-Open publication ho. H09-179473

SUMMARY OF INVENTION

Technical Problem

However, such a replacement of an entire process unit, since still usable devices around the photoreceptor drum have to be also integrally replaced and discarded although the replacement of only a photoreceptor drum may be sufficient, has had problems such as an increase in running cost, an increase in waste amount as an industrial waste, and an adverse influence on the environment.

The cause of such problems lies in the fact that a photoreceptor dram, since being a maintenance component that requires to be handled with extreme care, is rigidly assembled to a unit frame body and a structure in which a photoreceptor drum alone can be easily attached and detached has not been adopted.

In view of the foregoing problems, an object of the present invention is to provide a process unit in which a photoreceptor drum can be simply handled and also can be easily attached and detached.

Solution to Problem

A process unit of the present invention is a cartridge type unit that is configured integrally with a plurality of maintenance components that have a different life span. In preferred embodiments of the present invention, the process unit has a photoreceptor drum, a frame body, a cleaning blade, a lock member, and a biasing member. The photoreceptor drum is one of the plurality of maintenance components. The photoreceptor drum has a first shaft portion projecting from a first end of the photoreceptor drum and a second shaft portion projecting from a second end of the photoreceptor drum. The frame body has: a mounting space in which the photoreceptor drum is mounted, the mounting space opening forward; a pair of first and second receiving portions opposed to each other in a longitudinal direction of the mounting space; and a hole that is provided in the first receiving portion and fitted over the first shaft portion at the first end of the photoreceptor drum so as to support the first shaft portion. The cleaning blade is arranged in the frame body and has a tip end portion projecting from a back side of the mounting space to an inside of the mounting space and contacting a surface of the photoreceptor drum with a pressing force. The lock member, facing a front side of the mounting space, is provided movably in the second receiving portion in an axial direction of the photoreceptor drum. The lock member rotatably supports the second shaft portion at the second end of the photoreceptor drum and locks the photoreceptor drum in a mounted state. The biasing member biases the lock member to the first end of the photoreceptor drum.

According to the configuration of the above-described process unit, when the photoreceptor drum is mounted on the frame body, the first shaft portion at the first end of the photoreceptor drum is kept fitted into a hole of the first receiving portion and the photoreceptor drum is moved from the front side of the mounting space to the inside of mounting space. The photoreceptor drum is temporarily supported by a repulsive force of the cleaning blade and positioned in a predetermined position in the mounting space. Then, in order to cause the lock member to support the second shaft portion at the second end of the photoreceptor drum, the lock member is retracted against a biasing force of the biasing member. Thereafter, the second shaft portion at the second end of the photoreceptor drum is supported by the lock member by a restoring force of the biasing member, so that the photoreceptor drum is locked in the mounted state. Thus, the photoreceptor drum is mounted on the frame body.

In addition, according to the configuration of the above-described, process unit, when the photoreceptor drum is removed from the frame body, the lock member is retracted against the biasing force of the biasing member so as to release the locking of the photoreceptor drum. The photoreceptor drum released from being looked is displaced in the axial direction in response to the restoring force of the biasing member and is surfaced toward the front side of the mounting space by the repulsive force of the cleaning blade. Then, while the second shaft portion at the second end of the photoreceptor drum is held, the first shaft portion at the first end is drawn out from the hole of the first receiving portion. Thus, the photoreceptor drum, is removed from the frame body.

It is to be noted on an end surface facing the mounting space of the lock member, a tapered surface that is inclined so as to expand the mounting space toward the front side of the mounting space may be formed. With this configuration, on the tapered surface of the lock member expanding toward the front side of the mounting space, the tip end of the second shaft portion at the second end of the photoreceptor drum is pressed toward the back side of the mounting space so as to be slid, and then a force against the biasing force of the biasing member is applied to the lock member, so that the lock member automatically moves in the direction in which the force is applied. Therefore, if is not necessary to operate the lock member by hand when the photoreceptor drum is mounted, which makes it possible to easily mount the photoreceptor drum.

It should be noted, if an auxiliary biasing member that presses and biases the cleaning blade on a surface of the photoreceptor drum is further provided, a pressing force applied to the photoreceptor drum by the cleaning blade can be increased by the auxiliary biasing member.

An example of the lock member may preferably include a ring shape member having a hole into which the second shaft portion at the second end of the photoreceptor drum is fitted. This makes it possible to support the entire perimeter of the second shaft portion by the hole of the lock member end to make the mounted state of the photoreceptor drum stable.

Another example of the lock member may preferably include a half ring shape member having a recessed portion with which the second shaft portion at the second end of the photoreceptor drum is engaged. Thus makes it possible to reduce the manufacturing cost of the lock member since the half of the material which forms the lock member is sufficient compared with the case in which the lock member has a ring shape.

Advantageous Effects of Invention

According to preferred embodiments of the present invention, a process unit having a photoreceptor drum that can be simply handled and easily attached and detached can be provided.

DESCRIPTION OF EMBODIMENTS

Figure 1:
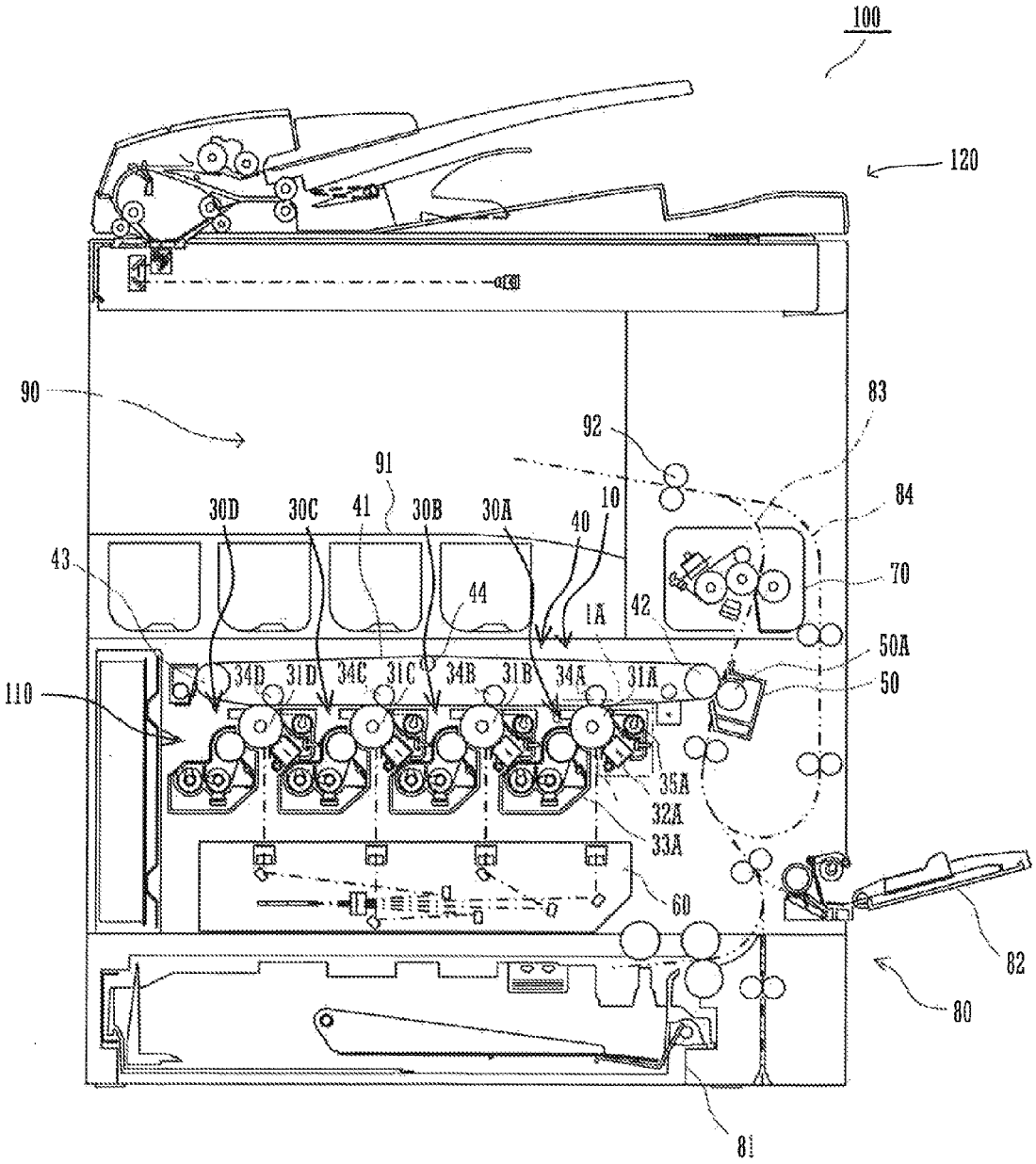
FIG. 1 is a sectional side view schematically showing an exemplary configuration of an image forming apparatus according to a first preferred embodiment of the present invention.

Hereinafter, preferred embodiments of the present invention will be described with reference to the drawings. FIG. 1 is a view schematically showing an exemplary configuration of an image forming apparatus according to a preferred embodiment of the present invention.

As shown in FIG. 1, an image forming apparatus 100 is configured to form a polychrome or monochrome image onto a predetermined sheet of paper based on image data that have been read from a document. The sheet of paper includes a sheet-like recording medium such as plain paper, cardboard, photographic paper, and an OHP film. The image forming apparatus 100 is equipped with an image reading device 120 on a main body and is equipped with an image forming portion 110 and a paper supply portion 80 in the main body.

The image reading device 120 irradiates the image bearing side of the document with light and generates image data by sensing a right quantity of reflected light.

The image forming portion 110 is equipped with an intermediate transfer unit 40, image forming stations 30A, 30B, 30C, and 30D, a secondary transfer unit 50, an exposure unit 60, and a fixing unit 70.

The intermediate transfer unit 40 is equipped with an intermediate transfer belt 41 which is an endless belt, a first stretching roller 42, a second stretching roller 43, and a tension roller 44. The intermediate transfer belt 41 is stretched over the first stretching roller 42, the second stretching roller 43, and the tension roller 44. As an example, the first stretching roller 42 is a driving roller while the second stretching roller 13 is a driven roller. The tension roller 44 adjusts the tensile force of the intermediate transfer belt 41.

The image forming stations 30A to 30D perform an electrophotographic image forming process using toners of respective colors of black, cyan, magenta, and yellow. The image forming stations 30A to 30D are arranged side by side so as to be opposed to a predetermined region of the intermediate transfer belt 41. The image forming stations 30B to 30D are each configured in the same manner as the image forming station 30A.

The image forming station 30A is equipped with a monochrome image forming photoreceptor drum 31A that bears black toner. The image forming stations 30B, 30C, and 30D are equipped with color image forming photoreceptor drums 31B, 31C, and 31D that bear color toner, respectively. Each of the photoreceptor drums 31A to 31D forms an image bearing member.

The image forming station 30A includes a charging device 32A, a developing device 33A, a primary transfer roller 34A, and a cleaner device 35A that are disposed around the photoreceptor drum 31A. Similarly, the image forming stations 30B, 30C, and 30D include primary transfer rollers 34B, 34C, and 34D, respectively.

The image forming station 30A is equipped with a cartridge type process unit 1A in which the photoreceptor drum 31A, the charging device 32A, and the cleaner device 35A that are a plurality of maintenance components that have a different life span are formed, integrally. The image forming stations 30B, 30C, and 30D are also equipped with a similar process unit.

The photoreceptor drum 31A is rotated in a predetermined direction by a driving power transmitted from a not-shown driving source. The charging device 32A electrostatically charges the peripheral surface of the photoreceptor drum 31A to a predetermined potential.

The exposure unit 60 is configured to drive a semiconductor laser based on image data items corresponding to respective colors of black, cyan, magenta, and yellow to distribute laser light corresponding to the respective colors to each of the photoreceptor drums 31A to 31D of the image forming stations 30A to 30D. On the peripheral surfaces of the photoreceptor drums 31A to 31D, electrostatic latent images based on the image data items corresponding to the respective colors of black, cyan, magenta, and yellow are formed.

The developing device 33A is configured to supply black toner that is the color of the image forming station 30A, onto the peripheral surface of the photoreceptor drum 31A, thereby visualizing the electrostatic latent image into a toner image.

The intermediate transfer belt 41 has a surface that comes to face the photoreceptor drums 31A to 31D sequentially. The primary transfer roller 34A is arranged in a position opposed to the photoreceptor drum 31A across the intermediate transfer belt 41. The primary transfer roller 34B is arranged in a position opposed to the photoreceptor drum 31B across the intermediate transfer belt 41. The primary transfer roller 34C is arranged in a position opposed to the photoreceptor drum 31C across the intermediate transfer belt 41. The primary transfer roller 34D is arranged in a position opposed to the photoreceptor drum 31D across the intermediate transfer belt 41.

The primary transfer roller 34A, by being applied with a primary transfer bias of an opposite polarity (positive, for example) to the electrostatically charged polarity (negative, for example) of the toner, primarily transfers the toner image born on the photoreceptor drum 31A onto the surface of the intermediate transfer belt 41. The intermediate transfer unit 40 and the primary transfer rollers 34A to 34D are included in a transfer device 10.

Residual toner remaining on the surface of the photoreceptor drum 31A is removed by the cleaner device 35A. The cleaner device 35A, as will be described later, is equipped with a cleaning blade 351 having elasticity and a waste toner feeding screw 352. The cleaning blade 351 contacts the surface of the photoreceptor drum 31A and scrapes away the residual toner remaining on the surface. The waste toner feeding screw 352 is fed to one end side in the longitudinal direction of the frame body 400 in order to collect waste toners that have been scraped off by the cleaning blade 351.

During monochrome image formation, only the monochrome image forming station 30A performs the above described image forming process. Moreover, during full-color image formation, the image forming stations 30B to 30D in addition to the image forming station 30A perform the same process for the respective colors of cyan, magenta, and yellow, as does the image forming station 30A. The resulting toner images of the respective colors of black, cyan, magenta, and yellow, by the respective primary transfer rollers 34A to 34D of the image forming stations 30A to 30D applied with the primary transfer bias, are sequentially transferred onto the surface of the intermediate transfer belt 41 so as to be superimposed on one another to form one image.

The sheet supply portion 80 is provided with a sheet supply cassette 81, a manual supply tray 82, a main sheet feed path 83, and a subsidiary sheet feed path 84. In the sheet supply cassette 81, a plurality of sheets of paper of a size and kind with a relatively high frequency in use are stored. On the manual supply tray 82, a plurality of sheets of paper of a size and kind with a relatively low frequency in use are placed.

The main sheet feed, path 83 is formed to extend from the sheet supply cassette 81 and the manual supply tray 82 to a sheet discharge portion 90 by passing between the intermediate transfer belt 41 and the secondary transfer unit 50 and through the fixing unit 70. The subsidiary sheet feed path 84, which is a sheet feed path for double-sided printing, is formed in such a manner a sheet bearing an image formed on one side of a sheet of paper is turned upside down and then fed to between the intermediate transfer belt 41 and the second transfer unit 50 again.

The secondary transfer unit 50 has a secondary transfer roller 50A. The secondary transfer roller 50A, by being applied with a secondary transfer bias of an opposite polarity (positive, for example) to the electrostatically charged polarity (negative, for example) of the toner, transfers the toner image born on the surface of the intermediate transfer belt 41 onto a sheet of paper. The secondary transfer unit 50 is included in the transfer device 10.

The fixing unit 70, by heating and pressurizing the sheet of paper onto which the toner image has been transferred, fixes the toner image on the sheet of paper.

The sheet discharge portion 90 is equipped, with a sheet discharge tray 91 and a sheet discharge roller 92. The sheet, of paper on which the toner image has been fixed is discharged to the sheet discharge tray 91 by the sheet discharge roller 92. The sheet of paper is accommodated in the sheet discharge tray 91 with the side on which the toner image has been fixed facing downward.

Subsequently, a description is made of a configuration and operation of a characteristic process unit according to preferred embodiments of the present invention with reference to FIG. 2 to FIGS. 10A and 10B.

Figure 2:
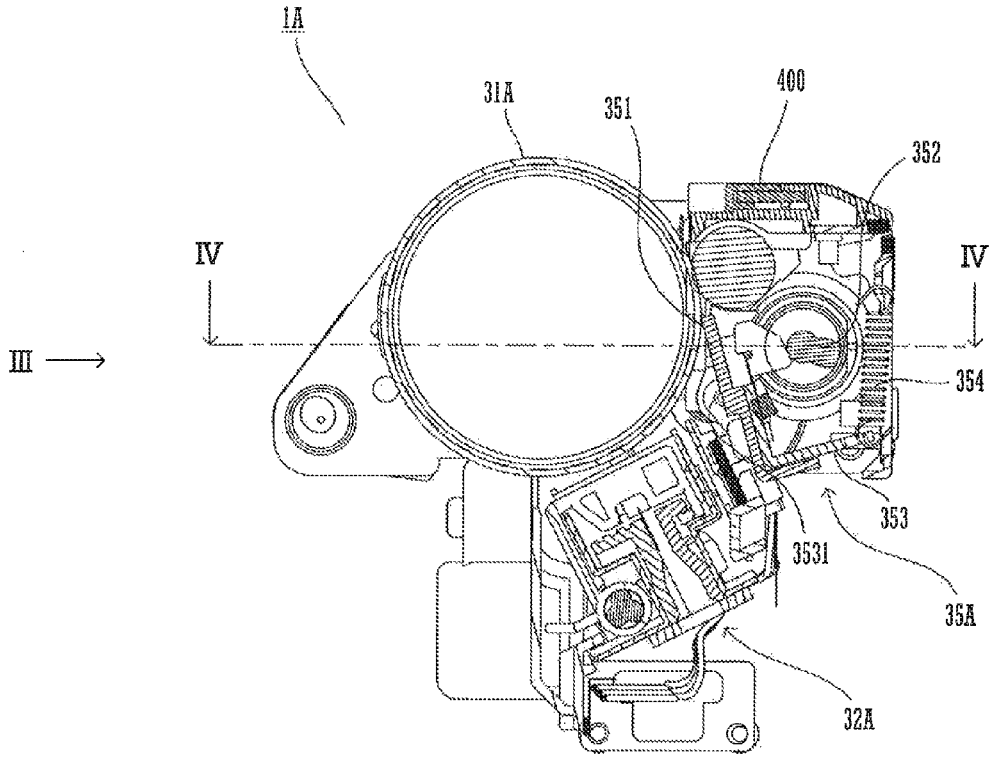
FIG. 2 is a sectional side view showing a process unit of the image forming apparatus.

FIG. 2 is a cross-sectional view showing the process unit. While, in the following description, as a representative example of the plurality of the image forming stations 30A to 30D, the process unit 1A to be used for the image forming station 30A for black will be described, a process unit to be used for other image forming stations 30B to 30D is also similar.

As described above, as shown, in FIG. 2, the process unit 1A is a cartridge type unit in which the photoreceptor drum 31A, the charging device 32A, and the cleaner device 35A that are formed integrally. The photoreceptor drum 31A, the charging device 32A, and the cleaner device 35A are arranged in a unit frame body (hereinafter will be simply referred to as a frame body) 400. In the present preferred embodiment, while the charging device 32A and the cleaner device 35A that are maintenance components having a comparatively long life span are rigidly mounted on the frame body 400 using a screw or the like, the photoreceptor drum 31A having the shortest life span is detachably mounted on the frame body 400 so as to be capable of being replaced alone.

Figure 3:
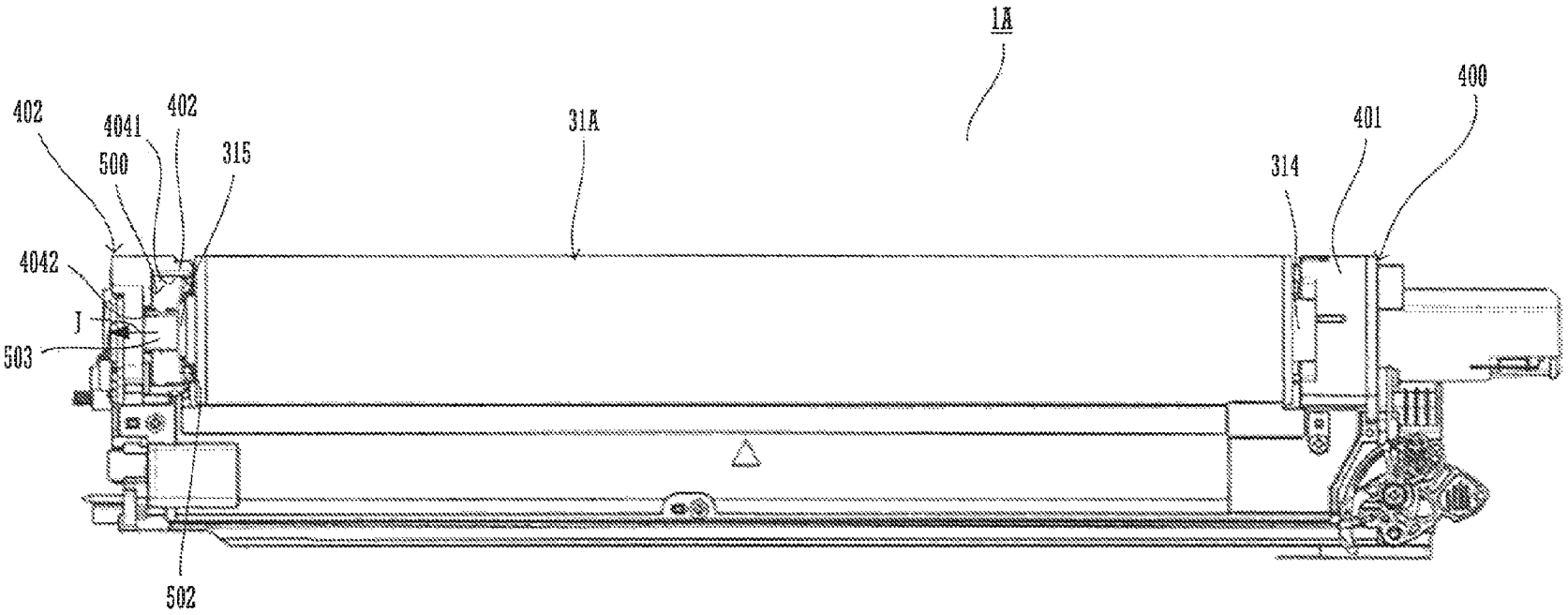
FIG. 3 is a front view in an arrow III direction in FIG. 2.
Figure 4:
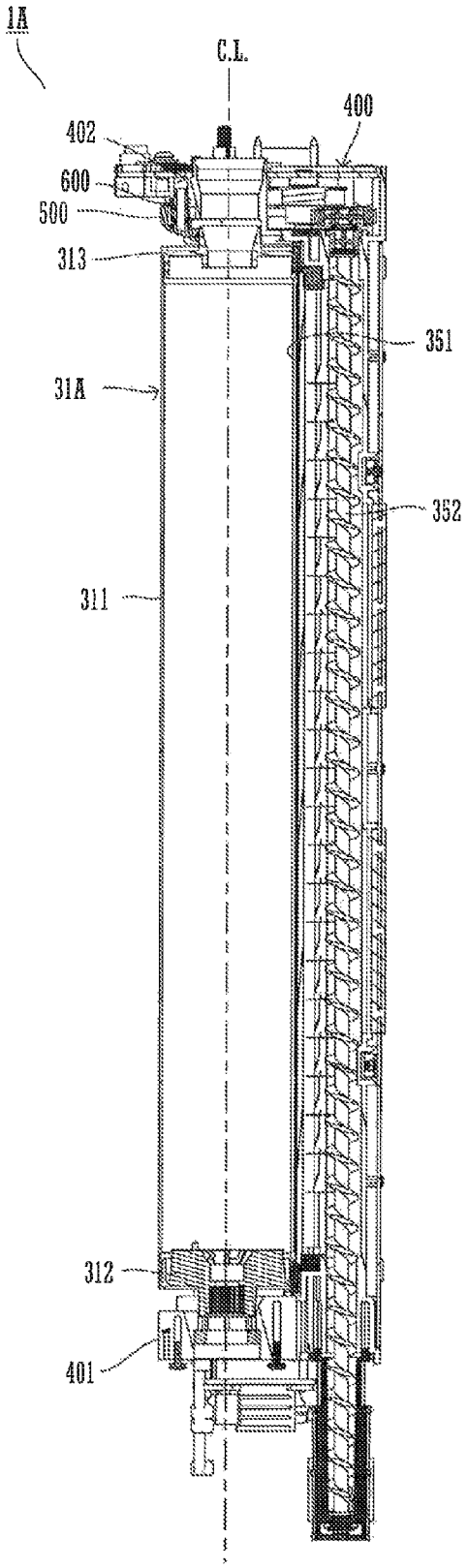
FIG. 4 is a cross-sectional view in a direction of an arrow line IV-IV in FIG. 2.
Figure 5:
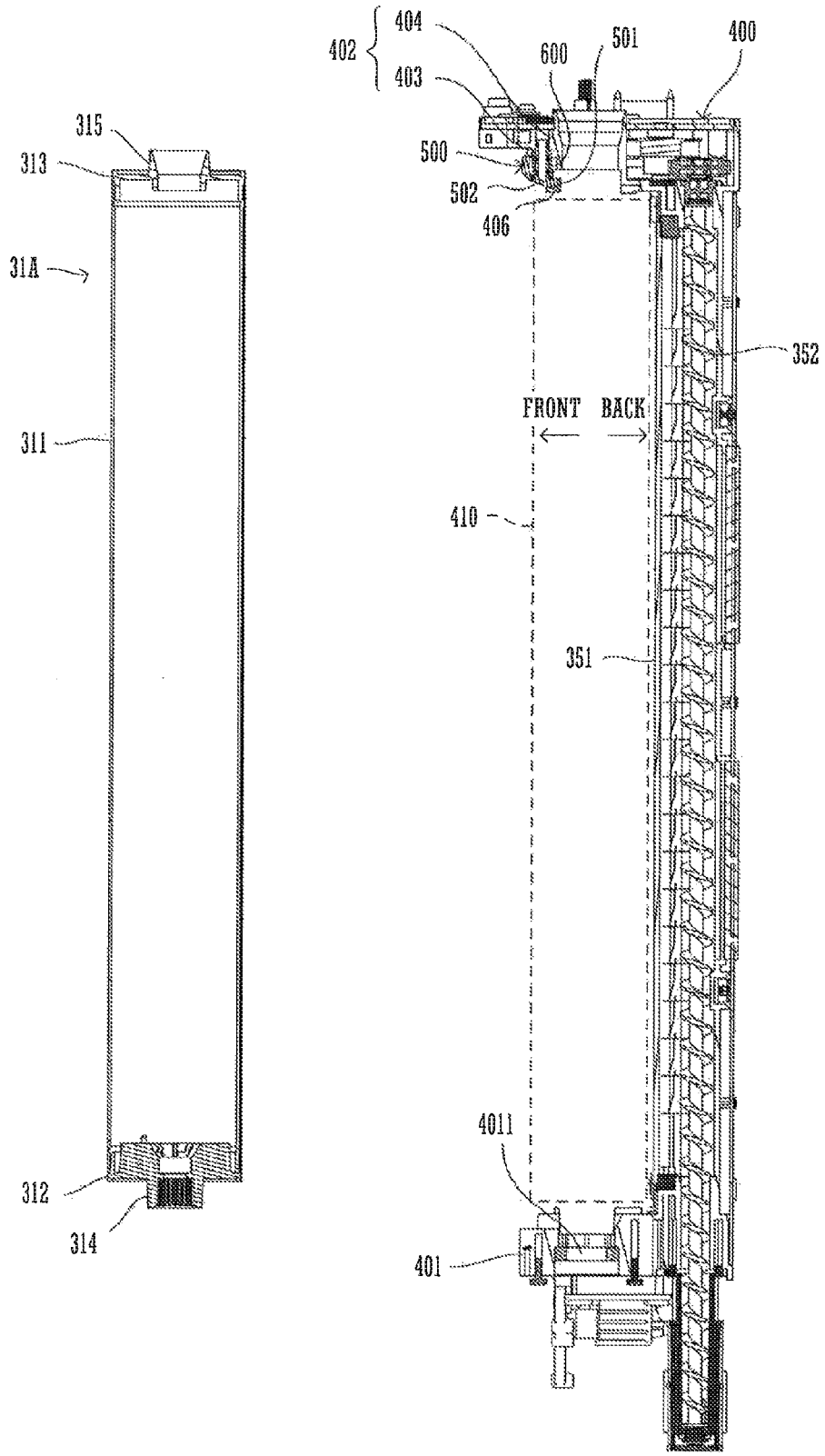
FIG. 5 is an equivalent cross-sectional view in the direction of the arrow line IV-IV in FIG. 2, showing a state in which a photoreceptor drum is removed front a unit frame body.

FIG. 3 is a front view in which the process unit 1A is viewed from an arrow III direction in FIG. 2, and FIG. 4 is a cross-sectional view in a direction of an arrow line IV-IV in FIG. 2. FIG. 5 is a view showing a state in which a photoreceptor drum in FIG. 4 is removed.

As shown in FIG. 5, the frame body 400 has a mounting space 410 for the photoreceptor drum 31A, the mounting space being opened outward. On the opposite ends in the longitudinal direction (vertical direction in FIG. 5) of the mounting space 410, a pair of first and second receiving portions 401, 402 that are integrally formed with the frame body 400 face each other.

In addition, as shown in FIG. 4 and FIG. 5, the photoreceptor drum 31A includes a cylindrically shaped drum main body 311, and drum flanges 312 and 313 that are attached on both ends in the axial direction of the drum main body 311. As shown in FIG. 5, the drum flanges 312 and 313 each have cylindrically shaped first and second shaft portions 314 and 315 integrally formed, respectively. With this configuration, the cylindrically shaped first and second shaft portions 314 and 315 project from a first end and a second end of the photoreceptor drum 31A.

The photoreceptor drum 31A includes a rotating shaft (not shown) that penetrates the drum, main body 311 and both drum flanges 312 and 313 and functions as a guide shaft that guides the photoreceptor drum 31A when the process unit 1A is inserted in the longitudinal direction and mounted on the main body of the image forming apparatus 100. At such a time, on the side of the first receiving portion 401 of the frame body 400, a drive connection member (not shown) is screwed and fastened on the shaft end surface of the rotating shaft (not shown), which makes one of the drum flanges 312 held and fixed between the shaft end surface of the rotating shaft (not shown) and the drive connection member (not shown), so that a driving force from a driving source (not shown) arranged on the side of the main body of the image forming apparatus 100 can be transmitted to the photoreceptor drum 31A through the drive connection member (not shown).

Figure 6:
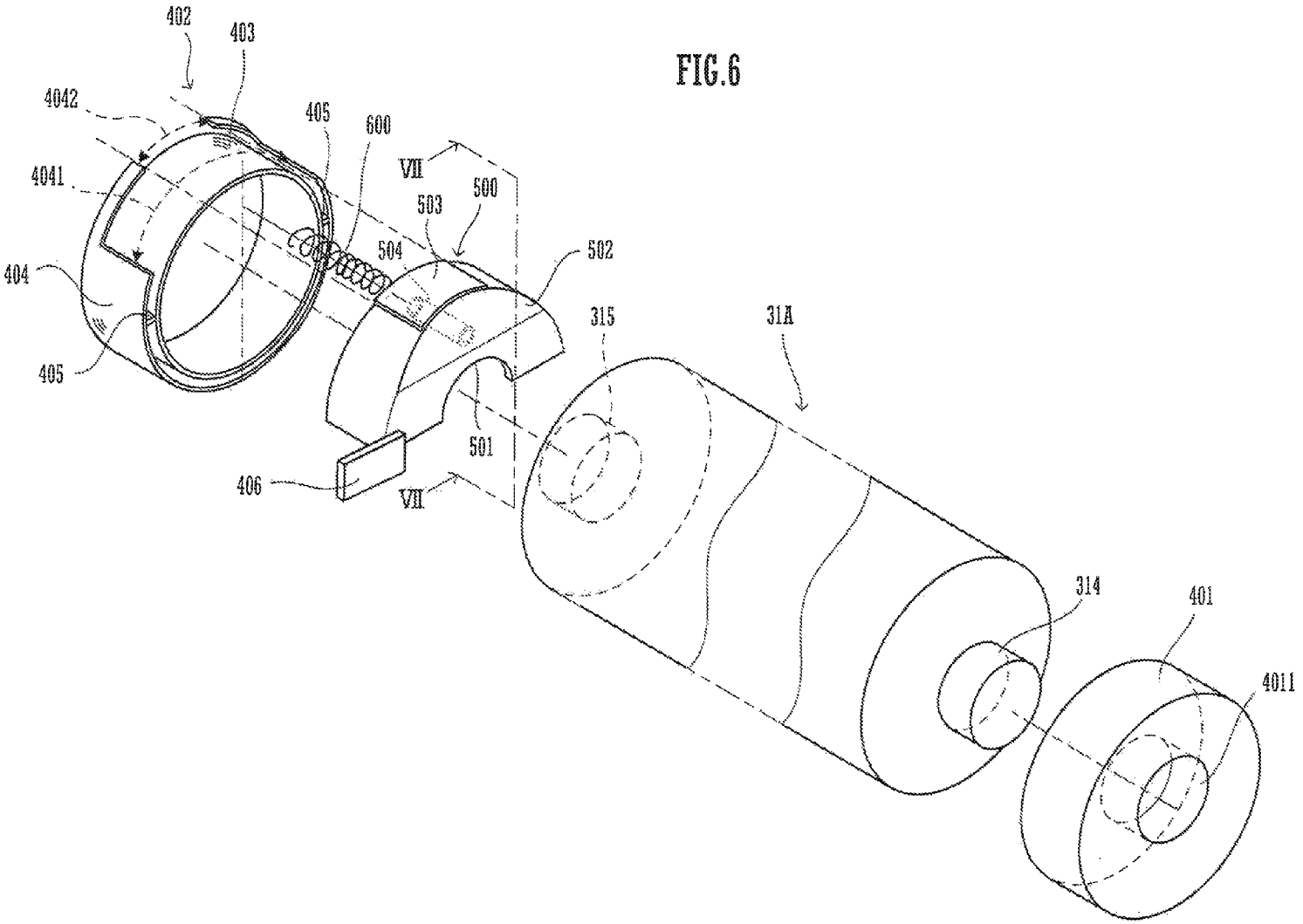
FIG. 6 is a perspective view schematically showing a configuration of a support structure of the photoreceptor drum in the process unit.

FIG. 6 is a perspective view schematically showing a configuration of a support structure of the photoreceptor drum in the process unit. A pair of first and second receiving portions 401 and 402 is formed in a cylindrical shape. The first receiving portion 401 has a hole 4011 that is fitted over the first shaft portion 314 at the first end of the photoreceptor drum 31A and supports the first shaft portion 314. The second receiving portion 402 may be configured with double cylinders that consist of an inner cylinder 403 and an outer cylinder 404. Into a gap between the inner cylinder 403 and the outer cylinder 404, a lock member 500 to be described below is fitted to be freely slid.

Figure 7:
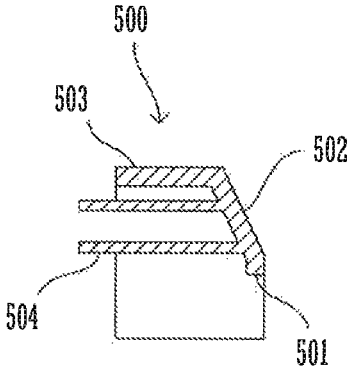
FIG. 7 is a cross-sectional view showing an example of a look member and is a cross-sectional view in a detection of an arrow line VII-VII in FIG. 6.

FIG. 7 is a cross-sectional view in the axial direction of the lock member 500 and an equivalent cross-sectional view taken along an arrow line VII-VII in FIG. 6. As shown in FIG. 6 and FIG. 7, the lock member 500 is a half-ring shape member formed to be thin as an example. The lock member 500 has a semicircular recessed portion 501 at the center. The recessed portion 501 is engaged with the second shaft portion 315 at the second end of the photoreceptor drum 31A.

On the top portion of the periphery surface of the lock member 500, as an example, a rectangular operating portion 503 is raised and integrally formed. The operating portion 503 is a portion that is operated by hooking a finger when the lock member 500 is retracted. The end surface of the lock member 500 may include a tapered surface 502 that is inclined so as to expand the mounting space 410 toward the front side of the mounting space 410 (see FIG. 5).

As shown, in FIG. 6, the first receiving portion 401 has a cylindrical shape having the hole 4011 as an example. The first shaft portion 314 at the first end of the photoreceptor drum 31A is supported by the first receiving portion 401 by being fitting into the hole 4011 of the center of the first receiving portion 401.

The second receiving portion 402 may be formed into a double cylindrical shape that is coaxially formed of an inner cylinder 403 and an outer cylinder 404. As shown in FIG. 6, the upper part of the outer cylinder 404 is cut out so as to be L-shaped by a first cutout 4041 and a second, cutout 4042. The first cutout 4041 is set to have a wide width (length in a circumferential direction) and the second cutout 4042 is set to have a narrow width. The first cutout 4042, in the length direction, is positioned on the side of the tip end of the outer cylinder 404, and the second cutout 4042 is positioned on the side of the foundation of the outer cylinder 404. The first cutout 4041 and the second cutout 4042 have a matched center line in the width direction and are formed line symmetrically with respect to this center line.

As shown in FIG. 6, the lock member 500 is fitted into a gap between the inner cylinder 403 and the outer cylinder 404 of the second receiving portion 402. The operating portion 503 that is raised from the peripheral surface of the lock member 500, as shown in FIG. 3, is positioned inside the second cutout 4042 of the outer cylinder 404 and slides using the second cutout 4042 as a guide. The tapered surface 502 of the lock member 500 is positioned in the front part of the mounting space 410 (see FIG. 5) and faces the front side of the mounting space 410 as an opening side through the first cutout 4041.

The lock member 500 is movable in the axial direction of the photoreceptor drum 31A from a position in which the inside of the end surface of the lock member 500 contacts the tip end surface of the inner cylinder 403 to a position in which the lock member 500 is restricted by a stopper 406 provided on the frame body 400. Positioning of the circumferential direction of the lock member 500 is performed by a partition wall 405 formed between the inner cylinder 403 and the outer cylinder 404 so as to prevent the rotation of the look member 500.

In addition, on the inside of the end surface of the lock member 500, a boss 304 is provided in a projecting manner. To the boss 504 is attached a compression coil spring 600 that is an example of the biasing member defined by the present invention. The compression coil spring 600 biases the lock member 500 to the first end of the photoreceptor drum 31A, and the lock member 500 is constantly biased to a position of being restricted by the stopper 406 within a movable range.

Figure 8:
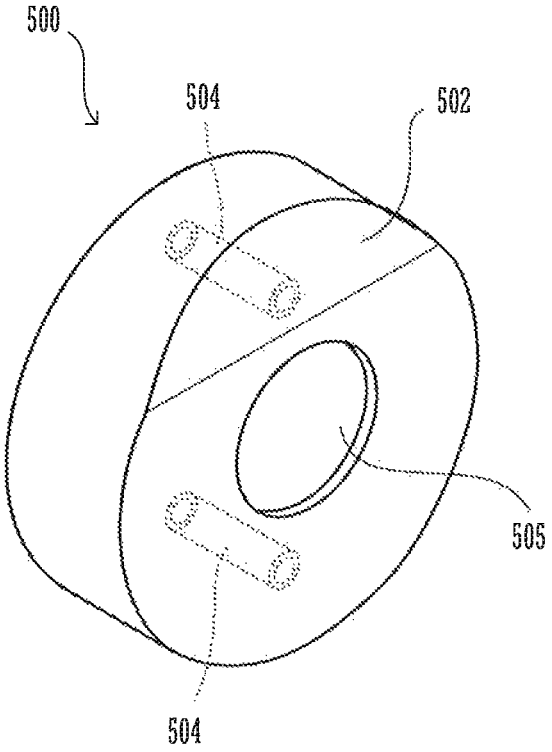
FIG. 8 is a perspective view showing another example of the lock member.

FIG. 8 is a perspective view showing another example of the lock member 500. In this example, the lock member 300 has a ring shape having a hole 505. Into the hole 505, the second shaft portion 315 at the second end of the photoreceptor drum 31A is fitted. Therefore, the lock member 500 of the preferred embodiment of the present invention can support the second shaft portion 315 over the entire circumference, so that the mounted state of the photoreceptor drum 31A is stabilized. On the other hand, in a case in which the lock member 500 has a half-ring shape as in the example of FIG. 7, since the half of a material to form the lock member 500 is sufficient compared with a case in which for the lock member 500 has a ring shape, the manufacturing cost of the lock member 500 can be reduced.

As shown in FIG. 5, the cleaning blade 351 is arranged in the frame body 400 in the back side of the mounting space 410. The cleaning blade 351 is formed of a material having flexibility (rubber, for example). As shown in FIG. 2, the cleaning blade 351 is attached to an L-shaped support member 333, and the tip end portion of the cleaning blade 351 projects from the back side of the mounting space 410 to the inside of the mounting space 410 so as to contact the center portion in the height direction of the peripheral surface on the back side of the drum main body 311 of the photoreceptor drum 31A by a pressing force along the axial direction. Accordingly, the pressing force is applied to the photoreceptor drum 31A from the back side.

The support member 353 is pivotally supported by the frame body 400 around a support point 3531 set at an end portion closer to the photoreceptor drum 31A in the short length direction, and an end portion farther from the photoreceptor drum 31A is biased upward with a tension coil spring 354. The tension coil spring 354 is an example of the auxiliary biasing member defined by the present invention. The tension coil spring 354 increases the pressing force applied to the photoreceptor drum 31A by the cleaning blade 351.

With reference to FIGS. 9A, 9B, and 9C and FIGS. 10A and 10B, the mounting procedure of the photoreceptor drum 31A to the frame body 400 will be described.

Figure 9A:
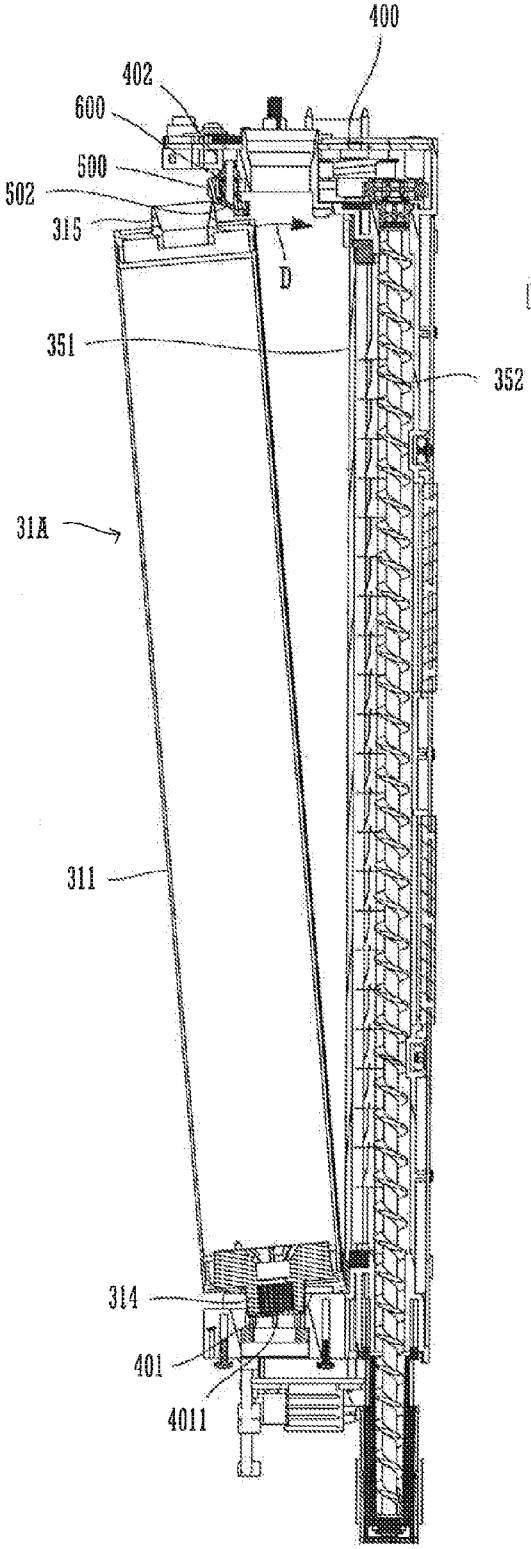
FIGS. 9A, 9B, and 9C are views illustrating a mounting procedure in which the photoreceptor drum is mounted on the unit frame body, by using a cross-section in the direction of the arrow line IV-IV in FIG. 2.
Figure 9B:
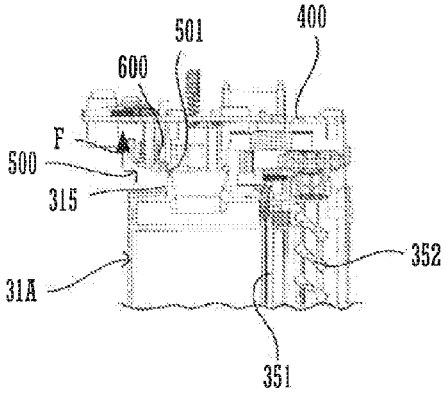

To begin with, as shown in FIG. 9A, the first shaft portion 314 at the first end of the photoreceptor drum 31A is fitted into the hole 4011 of the first receiving portion 401 of the frame body 400. Subsequently, as shown with an arrow D in FIG. 9A, through the second shaft portion 315 at the second end of the photoreceptor drum 31A, the photoreceptor drum 31A is pressed in the mounting direction. At such a time, if the upper part of the tapered surface 502 of the lock member 500 that expands toward the front side of the mounting space 410 (see FIG. 5) is pressed on toward the back side of the mounting space 410 so as to slide the tip end of the second shaft portion 315 at the second end of the photoreceptor drum 31A, a force against the biasing force by the compression coil spring 600 applied to the lock member 500 and thus, as shown with an arrow F in FIG. 9B, the lock member 500 automatically retracts. Therefore, it is not necessary to operate the lock member 500 by hand.

Figure 10A:
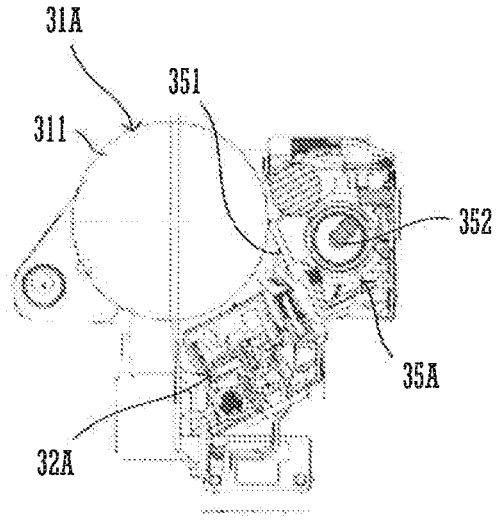
FIG. 10A is a sectional side view of the process unit, showing a temporary support state of the photoreceptor drum corresponding to FIG. 9B).

The tip end portion of the cleaning blade 351 projects from the back side of the mounting space 410 to the inside of the mounting space 410. Therefore, as shown in FIG. 10A, the tip end portion of the cleaning blade 351 contacts the surface of the back side of the drum main body 311 of the photoreceptor drum 31A so as to temporarily support the photoreceptor drum 31A by the repulsive force of the cleaning blade 351, which makes it possible to position the photoreceptor drum 31A in a predetermined position of the mounting space 410. Accordingly, after the first shaft portion 314 at the first end of the photoreceptor drum 31A is fitted into the hole 4011 of the first receiving portion 401, only the second shaft portion 315 at the second end is sufficient as a portion in which the photoreceptor drum 31A is held until the mounting of the photoreceptor drum 31A is completed, so that the photoreceptor drum 31A can be very simply handled.

Figure 9C:
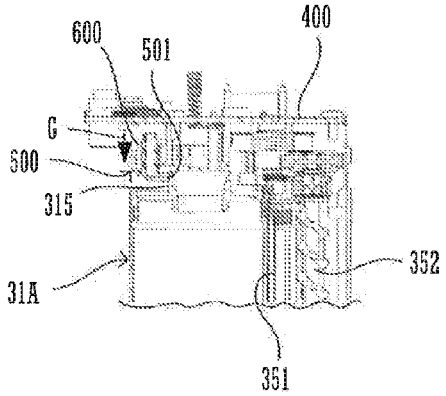

When the lock member 500 is pressed up to a position in which the second shaft portion 315 at the second end of the photoreceptor drum 31A is engaged with the recessed portion 501 of the lock portion 500, the lock portion 500 is moved like an arrow G shown in FIG. 9C by the biasing force of the compression coil spring 600, comes into contact with the stopper 406, and stops. Accordingly, the second shaft portion 315 at the second end of the photoreceptor drum 31A is engaged with the recessed portion 501 of the lock member 500, so that the photoreceptor drum 31A is locked in the mounted state. By such a procedure, the photoreceptor drum 31A can be easily mounted on the frame body 400.

Figure 10B:
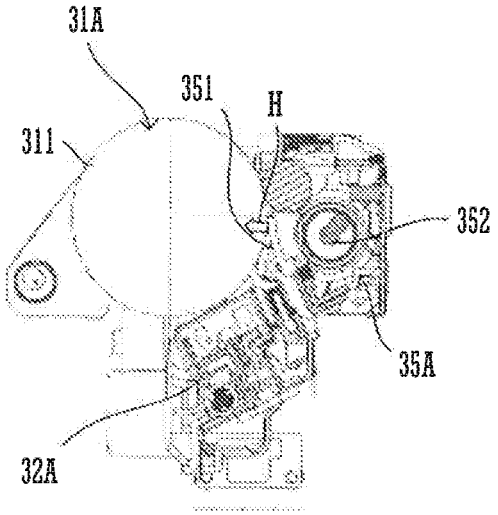
FIG. 10B is a sectional side view of the process unit, showing a mounted state of the photoreceptor drum (corresponding to FIG. 9C).

It is to be noted while the recessed portion 501 is a semicircle and has only a circumferential length corresponding to an approximately half circumferential length of the second shaft portion 315, and, as shown in FIG. 5, the recessed portion 501 faces the back side of the mounting space 410 and the photoreceptor drum 31A, as shown in FIG. 10B, receives a pressing force (see an arrow H in FIG. 10B) by the cleaning blade 351 that is deflected to the back side, the second shaft portion 315 does not fall into the back side of the mounting space 410, which makes it possible to cause the second shaft portion 315 to be reliably engaged with the recessed portion 501.

Subsequently, a procedure when removing the photoreceptor drum 31A from the frame body 400 is described. In such a case, like an arrow J in FIG. 3, the operating portion 503 of the lock member 500 is operated by hand against the biasing force by the compression coil spring 600 to be retracted, which thus releases an engagement state. If a hand is lifted from the lock member 500, the photoreceptor dram 31A of which the engagement state has been released is displaced in the axial direction in response to the restoring force of the compression coil spring 600 and is surfaced toward the front side of the mounting space 410 by the cleaning blade 351. This enables the second shaft portion 315 at the second end of the photoreceptor drum 31A to be held. Therefore, if, with the second shaft portion 315 at the second end held, the first shaft portion 314 at the first end is drawn out from the hole 4011 of the first receiving portion 401, the photoreceptor drum 31A can be easily removed from the frame body 400.

According to preferred embodiments of the present invention, it is possible to easily replace a photoreceptor drum that is a short-lived maintenance component of a process unit. In other words, even a person who is not an expert serviceman can safely and easily replace a photoreceptor drum and other long-lived maintenance components are effectively used, so that the reduction of running cost can be attained.

The foregoing preferred embodiments are to be considered in all respects as illustrative and not restrictive. The scope of the present invention is defined by the following claims, not by the foregoing preferred embodiments. Further, the scope of the present invention is intended to include the scopes of the claims and all possible changes and modifications within the senses and scopes of equivalents.

REFERENCE SIGNS LIST

1A Process unit
31A Photoreceptor drum
311 Drum, main body
312, 313 Drum flange
314, 315 First shaft portion. Second shaft portion
32A Charging device
35A Cleaner device
351 Cleaning blade
354 Tension coil spring (auxiliary biasing member)
400 Frame body
401 First receiving portion
402 Second receiving portion
410 Mounting space
500 Lock member
501 Recessed portion
502 Tapered surface
503 Operating portion
600 Compression coil spring (biasing member)
100 Image forming apparatus

The invention claimed is:

1. A process unit being of a cartridge type and being configured integrally with a plurality of maintenance components that have a different life span, the process unit comprising:

a photoreceptor drum that is one of the plurality of maintenance components and has a first shaft portion projecting from a first end of the photoreceptor drum and a second shaft portion projecting from a second end of the photoreceptor drum;

a frame body including;

a mounting space in which the photoreceptor drum is mounted, the mounting space opening forward;

a pair of first and second receiving portions opposed to each other in a longitudinal direction of the mounting space; and a hole that is provided in the first receiving portion and fitted over the first shaft portion of the first end of the photoreceptor drum so as to support the first shaft portion; and a cleaning blade that is arranged in the frame body and has a front end portion projecting from a back side of the mounting space to an inside of the mounting space and contacting a surface of the photoreceptor drum with a pressing force;

a lock member that is provided movably in the second receiving portion in an axial direction of the photoreceptor drum, faces a front side of the mounting space, rotatably supports the second shaft portion of the second end of the photoreceptor drum, and locks the photoreceptor drum in a mounted state; and a biasing member that biases the lock member to the first end of the photoreceptor drum; wherein the lock member includes an end surface facing the mounting space; and the end surface includes a tapered surface that is inclined so as to expand the mounting space toward the front side of the mounting space and contacts the second end of the photoreceptor drum.

2. The process unit according to claim 1, further comprising an auxiliary biasing member that presses and biases the cleaning blade on the surface of the photoreceptor drum.

3. The process unit according to claim 1, wherein the lock member has a ring shape that has a hole into which the second shaft portion of the second end of the photoreceptor drum is fitted.

4. The process unit according to claim 1, wherein the lock member has a half ring shape that has a recessed portion with which the second shaft portion of the second end of the photoreceptor drum is engaged.

5. An image forming apparatus comprising the process unit according to claim 1.

6. The process unit according to claim 2, wherein the lock member has a ring shape that has a hole into which the second shaft portion of the second end of the photoreceptor drum is fitted.

7. The process unit according to claim 2, wherein the lock member has a half ring shape that has a recessed portion with which the second shaft portion of the second end of the photoreceptor drum is engaged.

* * * * *